US008982011B1

(12) United States Patent
Gregoire et al.

(10) Patent No.: US 8,982,011 B1
(45) Date of Patent: Mar. 17, 2015

(54) CONFORMAL ANTENNAS FOR MITIGATION OF STRUCTURAL BLOCKAGE

(75) Inventors: Daniel J. Gregoire, Thousand Oaks, CA (US); Joseph S. Colburn, Malibu, CA (US)

(73) Assignee: HRL Laboratories, LLC, Malibu, CA (US)

( * ) Notice: Subject to any disclaimer, the term of this patent is extended or adjusted under 35 U.S.C. 154(b) by 501 days.

(21) Appl. No.: 13/243,006

(22) Filed: Sep. 23, 2011

(51) Int. Cl.
*H01Q 15/02* (2006.01)

(52) U.S. Cl.
USPC ..... 343/909; 343/705

(58) Field of Classification Search
CPC ..... H01Q 1/282–1/283; H01Q 1/285–1/287; H01Q 1/38; H01Q 15/008; H01Q 19/065
USPC ..... 343/700 MS, 909, 705
See application file for complete search history.

(56) References Cited

U.S. PATENT DOCUMENTS

| | | | |
|---|---|---|---|
| 3,267,480 | A | 8/1966 | Lerner |
| 3,560,978 | A | 2/1971 | Himmel |
| 3,810,183 | A | 5/1974 | Krutsinger et al. |
| 3,961,333 | A | 6/1976 | Purinton |
| 4,045,800 | A | 8/1977 | Tang et al. |
| 4,051,477 | A | 9/1977 | Murphy et al. |
| 4,087,822 | A | 5/1978 | Maybell |
| 4,119,972 | A | 10/1978 | Fletcher et al. |
| 4,123,759 | A | 10/1978 | Hines et al. |
| 4,124,852 | A | 11/1978 | Steudel |
| 4,127,586 | A | 11/1978 | Rody et al. |
| 4,150,382 | A | 4/1979 | King |
| 4,173,759 | A | 11/1979 | Bakhru |
| 4,189,733 | A | 2/1980 | Malm |
| 4,217,587 | A | 8/1980 | Jacomini |
| 4,220,954 | A | 9/1980 | Marchand |
| 4,236,158 | A | 11/1980 | Daniel |
| 4,242,685 | A | 12/1980 | Sanford |
| 4,266,203 | A | 5/1981 | Saudreau et al. |
| 4,308,541 | A | 12/1981 | Frosch et al. |
| 4,367,475 | A | 1/1983 | Schiavone |

(Continued)

FOREIGN PATENT DOCUMENTS

| | | |
|---|---|---|
| DE | 196 00 609 | 4/1997 |
| EP | 0 539 297 | 4/1993 |

(Continued)

OTHER PUBLICATIONS

From U.S. Appl. No. 11/324,064 (now U.S. Patent No. 7,307,589), Application and Office Actions including but not limited to the office actions mailed on Apr. 18, 2007 and Aug. 23, 2007.

(Continued)

*Primary Examiner* — Dieu H Duong
(74) *Attorney, Agent, or Firm* — Ladas & Parry

(57) ABSTRACT

A method of and apparatus for mitigating adverse transmission and/or reception effects that an obstruction would otherwise have upon a RF signal to be transmitted or received, the RF signal being available at a feed point and wherein the obstruction is spaced from the feed point in a direction of desired transmission or reception. An artificial impedance surface is disposed adjacent the feed point and the obstruction, and the artificial impedance surface is designed (i) to have a spatially non-varying impedance function in a constant impedance region at least immediately adjacent the feed point and (ii) to have a non-constant impedance function in one or more regions spaced from the feed point and closer to the obstruction.

23 Claims, 15 Drawing Sheets

(56) References Cited

U.S. PATENT DOCUMENTS 4,370,659 A 1/1983 Chu et al.
4,387,377 A 6/1983 Kandler
4,395,713 A 7/1983 Nelson et al.
4,443,802 A 4/1984 Mayes
4,590,478 A 5/1986 Powers et al.
4,594,595 A 6/1986 Struckman
4,672,386 A 6/1987 Wood
4,684,953 A 8/1987 Hall
4,700,197 A 10/1987 Milne
4,737,795 A 4/1988 Nagy et al.
4,749,996 A 6/1988 Tresselt
4,760,402 A 7/1988 Mizuno et al.
4,782,346 A 11/1988 Sharma
4,803,494 A 2/1989 Norris et al.
4,821,040 A 4/1989 Johnson et al.
4,835,541 A 5/1989 Johnson et al.
4,843,400 A 6/1989 Tsao
4,843,403 A 6/1989 Lazari et al.
4,853,704 A 8/1989 Diaz et al.
4,903,033 A 2/1990 Tsao
4,905,014 A 2/1990 Gonzalez et al.
4,916,457 A 4/1990 Foy et al.
4,922,263 A 5/1990 Dubost et al.
4,958,165 A 9/1990 Axford
4,975,712 A 12/1990 Chen
5,021,795 A 6/1991 Masiulis
5,023,623 A 6/1991 Kreinheder et al.
5,070,340 A 12/1991 Diaz
5,081,466 A 1/1992 Bitter, Jr.
5,115,217 A 5/1992 McGrath et al.
5,146,235 A 9/1992 Frese
5,158,611 A 10/1992 Ural
5,208,603 A 5/1993 Yee
5,218,374 A 6/1993 Koert et al.
5,235,343 A 8/1993 Audren et al.
5,268,696 A 12/1993 Buck et al.
5,268,701 A 12/1993 Smith
5,278,562 A 1/1994 Martin et al.
5,287,116 A 2/1994 Iwasaki
5,287,118 A 2/1994 Budd
5,402,134 A 3/1995 Miller et al.
5,406,292 A 4/1995 Schnetzer et al.
5,519,408 A 5/1996 Schnetzer
5,525,954 A 6/1996 Komazaki et al.
5,531,018 A 7/1996 Saia et al.
5,532,709 A 7/1996 Talty
5,534,877 A 7/1996 Sorbello et al.
5,541,614 A 7/1996 Lam et al.
5,557,291 A 9/1996 Chu et al.
5,581,266 A 12/1996 Peng et al.
5,589,845 A 12/1996 Yandrofski et al.
5,598,172 A 1/1997 Chekroun
5,600,325 A 2/1997 Whelan et al.
5,611,940 A 3/1997 Zettler
5,619,365 A 4/1997 Rhoads et al.
5,619,366 A 4/1997 Rhoads et al.
5,621,571 A 4/1997 Bantli et al.
5,638,946 A 6/1997 Zabracky
5,644,319 A 7/1997 Chen et al.
5,694,134 A 12/1997 Barnes
5,709,245 A 1/1998 Miller
5,721,194 A 2/1998 Yandrofski et al.
5,767,807 A 6/1998 Pritchett
5,808,527 A 9/1998 De Los Santos
5,874,915 A 2/1999 Lee et al.
5,892,485 A 4/1999 Glabe et al.
5,894,288 A 4/1999 Lee et al.
5,905,465 A 5/1999 Olson et al.
5,923,303 A 7/1999 Schwengler et al.
5,926,139 A 7/1999 Korisch
5,929,819 A 7/1999 Grinberg
5,943,016 A 8/1999 Snyder, Jr. et al.
5,945,951 A 8/1999 Monte et al.
5,949,382 A 9/1999 Quan
5,966,096 A 10/1999 Brachat
5,966,101 A 10/1999 Haub et al.
6,005,519 A 12/1999 Burns
6,005,521 A 12/1999 Suguro et al.
6,008,770 A 12/1999 Sugawara
6,016,125 A 1/2000 Johansson
6,028,561 A 2/2000 Taker
6,028,692 A 2/2000 Rhoads et al.
6,034,644 A 3/2000 Okabe et al.
6,034,655 A 3/2000 You
6,037,905 A 3/2000 Koscica et al.
6,040,803 A 3/2000 Spall
6,046,655 A 4/2000 Cipolla
6,046,659 A 4/2000 Loo et al.
6,054,659 A 4/2000 Lee et al.
6,055,079 A 4/2000 Hagans et al.
6,061,025 A 5/2000 Jackson et al.
6,075,485 A 6/2000 Lilly et al.
6,081,235 A 6/2000 Romanofsky et al.
6,081,239 A 6/2000 Sabet et al.
6,097,263 A 8/2000 Mueller et al.
6,097,343 A 8/2000 Goetz et al.
6,118,406 A 9/2000 Josypenko
6,118,410 A 9/2000 Nagy
6,127,908 A 10/2000 Bozler et al.
6,150,989 A 11/2000 Aubry
6,154,176 A 11/2000 Fathy et al.
6,166,705 A 12/2000 Mast et al.
6,175,337 B1 1/2001 Jasper, Jr. et al.
6,175,723 B1 1/2001 Rothwell, III
6,188,369 B1 2/2001 Okabe et al.
6,191,724 B1 2/2001 McEwan
6,198,438 B1 3/2001 Herd et al.
6,198,441 B1 3/2001 Okabe et al.
6,204,819 B1 3/2001 Hayes et al.
6,218,912 B1 4/2001 Mayer
6,218,997 B1 4/2001 Lindenmeier
6,246,377 B1 6/2001 Aiello et al.
6,252,473 B1 6/2001 Ando
6,285,325 B1 9/2001 Nalbandian
6,297,579 B1 10/2001 Martin et al.
6,307,519 B1 10/2001 Livingston et al.
6,317,095 B1 11/2001 Teshirogi et al.
6,323,826 B1 11/2001 Sievenpiper et al.
6,331,257 B1 12/2001 Loo et al.
6,337,668 B1 1/2002 Ito et al.
6,366,254 B1 4/2002 Sievenpiper et al.
6,373,349 B2 4/2002 Gilbert
6,380,895 B1 4/2002 Moren et al.
6,388,631 B1 5/2002 Livingston et al.
6,392,610 B1 5/2002 Braun et al.
6,404,390 B2 6/2002 Sheen
6,404,401 B2 6/2002 Gilbert et al.
6,407,719 B1 6/2002 Ohira et al.
6,417,807 B1 7/2002 Hsu et al.
6,424,319 B2 7/2002 Ebling et al.
6,426,722 B1 7/2002 Sievenpiper et al.
6,440,767 B1 8/2002 Loo et al.
6,469,673 B2 10/2002 Kaiponen
6,473,362 B1 10/2002 Gabbay
6,483,480 B1 11/2002 Sievenpiper et al.
6,496,155 B1 12/2002 Sievenpiper et al.
6,515,635 B2 2/2003 Chiang et al.
6,518,931 B1 2/2003 Sievenpiper
6,525,695 B2 2/2003 McKinzie
6,538,621 B1 3/2003 Sievenpiper et al.
6,552,696 B1 4/2003 Sievenpiper et al.
6,624,720 B1 9/2003 Allison et al.
6,642,889 B1 11/2003 McGrath
6,657,525 B1 12/2003 Dickens et al.
6,741,207 B1 5/2004 Allison et al.
6,822,622 B2 11/2004 Crawford et al.
6,864,848 B2 3/2005 Sievenpiper
6,897,810 B2 5/2005 Dai et al.
6,940,363 B2 9/2005 Ma et al.
7,068,234 B2 6/2006 Sievenpiper
7,071,888 B2 7/2006 Sievenpiper
7,164,387 B2 1/2007 Sievenpiper
7,173,565 B2 2/2007 Sievenpiper
7,218,281 B2 * 5/2007 Sievenpiper et al. .. 343/700 MS

(56) References Cited

U.S. PATENT DOCUMENTS

| | | | |
|---|---|---|---|
| 7,245,269 | B2 | 7/2007 | Sievenpiper et al. |
| 7,253,699 | B2 | 8/2007 | Schaffner |
| 7,253,780 | B2 | 8/2007 | Sievenpiper |
| 7,276,990 | B2 | 10/2007 | Sievenpiper |
| 7,298,228 | B2 | 11/2007 | Sievenpiper |
| 7,307,589 | B1 | 12/2007 | Gregoire |
| 7,782,255 | B2 | 8/2010 | Sego |
| 7,791,251 | B2 | 9/2010 | Kim |
| 7,830,310 | B1 | 11/2010 | Sievenpiper |
| 7,911,386 | B1 | 3/2011 | Itoh et al. |
| 8,212,739 | B2 | 7/2012 | Sievenpiper |
| 8,436,785 | B1 | 5/2013 | Lai |
| 2001/0035801 | A1 | 11/2001 | Gilbert |
| 2002/0036586 | A1 | 3/2002 | Chiang et al. |
| 2003/0034922 | A1 | 2/2003 | Isaacs et al. |
| 2003/0193446 | A1 | 10/2003 | Chen |
| 2003/0222738 | A1 | 12/2003 | Bang |
| 2003/0227351 | A1 | 12/2003 | Sievenpiper |
| 2004/0113713 | A1 | 6/2004 | Zipper et al. |
| 2004/0135649 | A1 | 7/2004 | Sievenpiper |
| 2004/0227583 | A1 | 11/2004 | Shaffner et al. |
| 2004/0227664 | A1 | 11/2004 | Noujeim |
| 2004/0227667 | A1 | 11/2004 | Sievenpiper |
| 2004/0227668 | A1 | 11/2004 | Sievenpiper |
| 2004/0227678 | A1 | 11/2004 | Sievenpiper |
| 2004/0263408 | A1 | 12/2004 | Sievenpiper et al. |
| 2005/0012667 | A1 | 1/2005 | Noujeim |
| 2006/0192465 | A1 | 8/2006 | Kornbluh et al. |
| 2013/0285871 | A1 | 10/2013 | Gregoire |

FOREIGN PATENT DOCUMENTS

| | | |
|---|---|---|
| EP | 1 158 605 | 11/2001 |
| FR | 2 785 476 | 5/2000 |
| GB | 1145208 | 3/1969 |
| GB | 2 281 662 | 3/1995 |
| GB | 2 328 748 | 3/1999 |
| JP | 61-260702 | 11/1986 |
| WO | 94/00891 | 1/1994 |
| WO | 96/29621 | 9/1996 |
| WO | 98/21734 | 5/1998 |
| WO | 99/50929 | 10/1999 |
| WO | 00/44012 | 7/2000 |
| WO | 01/31737 | 5/2001 |
| WO | 01/73891 | 10/2001 |
| WO | 01/73893 | 10/2001 |
| WO | 03/009501 | 1/2003 |
| WO | 03/098732 | 11/2003 |

OTHER PUBLICATIONS

From U.S. Appl. No. 12/939,040 (now U.S. Patent No. 8,436,785), Application and Office Actions including but not limited to the office action mailed on Jan. 10, 2013.

From U.S. Appl. No. 13/242,102, Application and Office Actions including but not limited to the office action mailed on Sep. 27, 2013.

From U.S. Appl. No. 13/934,553, Application and Office Actions.

Balanis, C., "Aperture Antennas," Antenna Theory, Analysis and Design, 2nd Edition, Ch. 12, pp. 575-597 (1997).

Balanis, C., "Microstrip Antennas," Antenna Theory, Analysis and Design, 2nd Edition, Ch. 14, pp. 722-736 (1997).

Bahl, I.J. And Trivedi, D.K., "A designer's guide to microstrip line", Microwaves, May 1977, pp. 174-182.

Bialkowski, M.E., et al., "Electronically Steered Antenna System for the Australian Mobilesat," IEEE Proc.-Microw. Antennas Propag., vol. 143, No. 4, pp. 347-352 (Aug. 1996).

Bradley, T.W., et al., "Development of a Voltage-Variable Dielectric (VVD), Electronic Scan Antenna," Radar 97, Publication No. 449, pp. 383-385 (Oct. 1997).

Brown, W.C., "The History of Power Transmission by Radio Waves," IEEE Transactions on Microwave Theory and Techniques, vol. MTT-32, No. 9, pp. 1230-1242 (Sep. 1984).

Bushbeck, M.D., et al., "A tunable switcher dielectric grating", IEEE Microwave and Guided Wave letters, vol. 3, No. 9, pp. 296-298 (Sep. 1993).

Chambers, B., et al., "Tunable Radar Absorbers Using Frequency Selective Surfaces," 11th International Conference on Antennas and Propagation, Conference Publication No. 480, pp. 593-598 (Apr. 17-20, 2001).

Chang, T.K., et al., "Frequency Selective Surfaces on Biased Ferrite Substrates", Electronics Letters, vol. 3o, No. 15, pp. 1193-1194 (Jul. 21, 1994).

Chen, P.W., et al., "Planar Double-Layer Leaky-Wave Microstrip Antenna," IEEE Transactions on Antennas and Propagation, vol. 50, pp. 832-835 (2002).

Chen, Q., et al., "FDTD diakoptic design of a slot-loop antenna excited by a coplanar waveguide," Proceedings of the 25th European Microwave Conference 1995, vol. 2, Conf. 25, pp. 815-819 (Sep. 4, 1995).

Cognard, J., "Alignment of Nematic Liquid Crystals and Their Mixtures," Mol. Cryst. Liq., Cryst. Suppl. 1, pp. 1-74 (1982).

Colburn, J.S., et al. "Adaptive artificial impedance surface conformal antennas," Antennas and Propagation Society International Symposium, 2009. APSURSI '09. IEEE, vol., no., pp. 1-4, Jun. 1-5, 2009.

Doane, J.W., et al., "Field Controlled Light Scattering from Nematic Microdroplets," Appl. Phys. Lett., vol. 48, pp. 269-271 (Jan. 1986).

Ellis, T.J. et al., "MM-Wave Tapered Slot Antennas on Micromachined Photonic Bandgap Dielectrics," 1996 IEEE MTT-S International Microwave Symposium Digest, vol. 2, pp. 1157-1160 (1996).

Fay, P., "High-Performance Antimonide-Based Heterostructure Backward Diodes for Millimeter-Wave Detection," IEEE Electron Device Letters, vol. 23, No. 10, pp. 585-587 (Oct. 2002).

Gianvittorio, J.P., et al., "Reconfigurable MEMS-enabled Frequency Selective surfaces", Electronic Letters, vol. 38, No. 25, pp. 16527-1628 (Dec. 5, 2002).

Gold, S.H., et al., "Review of High-Power Microwave Source Research," Rev. Sci. Instrum., vol. 68, No. 11, pp. 3945-3974 (Nov. 1997).

Grbic, A., et al., "Experimental Verification of Backward-Wave Radiation From a Negative Refractive Index Metamaterial," Journal of Applied Physics, vol. 92, No. 10, pp. 5930-5935 (Nov. 15, 2002).

Gregoire, D. and Colburn, J. S., "Artificial impedance surface antenna design and simulation", 2010 Proceedings of the 2010 Antenna Applications Symposium, pp. 288-303.

Hu, C.N., et al., "Analysis and Design of Large Leaky-Mode Array Employing the Coupled-Mode Approach," IEEE Transactions on Microwave Theory and Techniques, vol. 49, No. 4, pp. 629-636 (Apr. 2001).

Jablonski, W., et al., "Microwave Schottky Diode With Beam-Lead Contacts," 13th Conference on Microwaves, Radar and Wireless Communications, MIKON-2000, vol. 2, pp. 678-681 (2000).

Jensen, M.A., et al., "EM Interaction of Handset Antennas and a Human in Personal Communications," Proceedings of the IEEE, vol. 83, No. 1, pp. 7-17 (Jan. 1995).

Jensen, M.A., et al., "Performance Analysis of Antennas for Hand-Held Transceivers Using FDTD," IEEE Transactions on Antennas and Propagation, vol. 42, No. 8, pp. 1106-1113 (Aug. 1994).

Klopfenstein, R.W., "A transmission line of improved design", Proceedings of the IRE, pp. 31-35, Jan. 1956.

Koert, P., et al., "Millimeter Wave Technology for Space Power Beaming," IEEE Transactions on Microwave Theory and Techniques, vol. 40, No. 6, pp. 1251-1258 (Jun. 1992).

Lee, J.W., et al., "TM-Wave Reduction from Grooves in a Dielectric-Covered Ground Plane," IEEE Transactions on Antennas and Propagation, vol. 49, No. 1, pp. 104-105 (Jan. 2001).

Lezec, H.J., et al., "Beaming Light from a Subwavelength Aperture," Science, vol. 297, pp. 820-822 (Aug. 2, 2002).

Lima, A.C., et al., "Tunable Frequency Selective Surfaces Using Liquid Substrates", Electronic Letters, vol. 30, No. 4, pp. 281-282 (Feb. 17, 1994).

Linardou, I., et al., "Twin Vivaldi Antenna Fed by Coplanar Waveguide," Electronics Letters, vol. 33, No. 22, pp. 1835-1837 (1997).

(56) References Cited

OTHER PUBLICATIONS

Luukkonen et al, "Simple and accurate analytical model of planar grids and high-impedance surfaces comprising metal strips or patches", IEEE Trans. Antennas Prop., vol. 56, 1624, 2008.
Malherbe, A., et al., "The Compensation of Step Discontinues in TEM-Mode Transmission Lines," IEEE Transactions on Microwave Theory and Techniques, vol. MTT-26, No. 11, pp. 883-885 (Nov. 1978).
Maruhashi, K., et al., "Design and Performance of a Ka-Band Monolithic Phase Shifter Utilizing Nonresonant FET Switches," IEEE Transactions on Microwave Theory and Techniques, vol. 48, No. 8, pp. 1313-1317 (Aug. 2000).
McSpadden, J.O., et al., "Design and Experiments of a High-Conversion-Efficiency 5.8-GHz Rectenna," IEEE Transactions on Microwave Theory and Techniques, vol. 46, No. 12, pp. 2053-2060 (Dec. 1998).
Oak, A.C., et al., "A Varactor Tuned 16 Element MESFET grid Oscillator", Antennas an Propagation Society International Symposium, pp. 1296-1299 (1995).
Patel, A.M.; Grbic, A., "A Printed Leaky-Wave Antenna Based on a Sinusoidally-Modulated Reactance Surface," Antennas and Propagation, IEEE Transactions on , vol. 59, No. 6, pp. 2087,2096, Jun. 2011.
Perini, P., et al., "Angle and Space Diversity Comparisons in Different Mobile Radio Environments," IEEE Transactions on Antennas and Propagation, vol. 46, No. 6, pp. 764-775 (Jun. 1998).
Ramo, S., et al., Fields and Waves in Communication Electronics, 3rd Edition, Sections 9.8-9.11, pp. 476-487 (1994).
Rebeiz, G.M., et al., "RF MEMS Switches and Switch Circuits," IEEE Microwave Magazine, pp. 59-71 (Dec. 2001).
Schaffner, J., et al., "Reconfigurable Aperture Antennas Using RF MEMS Switches for Multi-Octave Tunability and Beam Steering," IEEE Antennas and Propagation Society International Symposium, 2000 Digest, vol. 1 of 4, pp. 321-324 (Jul. 16, 2000.
Schulman, J.N., et al., "Sb-Heterostructure Interband Backward Diodes," IEEE Electron Device Letters, vol. 21, No. 7, pp. 353-355 (Jul. 2000).
Semouchkina, E., et al., "Numerical Modeling and Experimental Study of a Novel Leaky Wave Antenna," Antennas and Propagation Society, IEEE International Symposium, vol. 4, pp. 234-237 (2001).
Sieveniper, D.F., et al., "Two-Dimensional Beam Steering Using an Electrically Tunable Impedance Surface," IEEE Transactions on Antennas and Propagation, vol. 51, No. 10, pp. 2713-2722 (Oct. 2003).
Sievenpiper, D. et al, "Holographic Artificial Impedance Surfaces for conformal antennas", 29th Antennas Applications Symposium, 2005.
Sievenpiper, D., et al. "A steerable leaky-wave antenna using a tunable impedance ground plane," Antennas and Wireless Propagation Letters, IEEE, vol. 1, No. 1, pp. 179-182, 2002.
Sievenpiper, D., et al., "Beam Steering Microwave Reflector Based on Electrically Tunable Impedance Surface," Electronics Letters, vol. 38, No. 21, pp. 1237-1238 (Oct. 1, 2002).
Sievenpiper, D., et al., "Eliminating Surface Currents With Metallodielectric Photonic Crystals," 1998 MTT-S International Microwave Symposium Digest, vol. 2, pp. 663-666 (Jun. 7, 1998).
Sievenpiper, D., et al., "High-Impedance Electromagnetic Surfaces with a Forbidden Frequency Band," IEEE Transactions, on Microwave Theory and Techniques, vol. 47, No. 11, pp. 2059-2074 (Nov. 1999).
Sievenpiper, D., et al., "High-Impedance Electromagnetic Surfaces," Ph.D. Dissertation, Dept. of Electrical Engineering, University of California, Los Angeles, CA, pp. i-xi, 1-150 (1999).
Sievenpiper, D., et al., "Low-Profile, Four-Sector Diversity Antenna on High-Impedance Ground Plane," Electronics Letters, vol. 36, No. 16, pp. 1343-1345 (Aug. 3, 2000).
Sievenpiper, D., et al., 2005 "Holographic Artificial Impedance Surfaces for Conformal Antennas" IEEE Antennas and Prop. Symp. Digest, vol. 1B, pp. 256-259, 2005.
Simovskii et al, "High-impedance surfaces having stable resonance with respect to polarization and incidence angel", IEEE Trans. Antennas Prop., vol. 53, 908, 2005.
Sor, J., et al., "A Reconfigurable Leaky-Wave/Patch Microstrip Aperture for Phased-Array Applications," IEEE Transactions on Microwave Theory and Techniques, vol. 50, No. 8, pp. 1877-1884 (Aug. 2002).
Strasser, B., et al., "5.8-GHz Circularly Polarized Rectifying Antenna for Wireless Microwave Power Transmission," IEEE Transactions on Microwave Theory and Techniques, vol. 50, No. 8, pp. 1870-1876 (Aug. 2002).
Swartz, N., "Ready for CDMA 2000 1xEV-Do?," Wireless Review, 2 pages total (Oct. 29, 2001).
Vaughan, Mark J., et al., "InP-Based 28 Gh.sub.2 Integrated Antennas for Point-to-Multipoint Distribution," Proceedings of the IEEE/Cornell Conference on Advanced Concepts in High Speed Semiconductor Devices and Circuits, pp. 75-84 (1995).
Vaughan, R., "Spaced Directive Antennas for Mobile Communications by the Fourier Transform Method," IEEE Transactions on Antennas and Propagation, vol. 48, No. 7, pp. 1025-1032 (Jul. 2000).
Wang, C.J., et al., "Two-Dimensional Scanning Leaky-Wave Antenna by Utilizing the Phased Array," IEEE Microwave and Wireless Components Letters, vol. 12, No. 8, pp. 311-313, (Aug. 2002).
Wu, S.T., et al., "High Birefringence and Wide Nematic Range Bis-Tolane Liquid Crystals," Appl. Phys. Lett., vol. 74, No. 5, pp. 344-346 (Jan. 18, 1999).
Yang, F.R., et al., "A Uniplanar Compact Photonic-Bandgap (UC-PBG) Structure and Its Applications for Microwave Circuits," IEEE Transactions on Microwave Theory and Techniques, vol. 47, No. 8, pp. 1509-1514 (Aug. 1999).
Yang, Hung-Yu David, et al., "Theory of Line-Source Radiation From a Metal-Strip Grating Dielectric-Slab Structure," IEEE Transactions on Antennas and Propagation, vol. 48, No. 4, pp. 556-564 (2000).
Yashchyshyn, Y., et al., The Leaky-Wave Antenna With Ferroelectric Substrate, 14th International Conference on Microwaves, Radar and Wireless Communications, MIKON-2002, vol. 2, pp. 218-221 (2002).
D. J. Gregoire and J. S. Colburn, "Artificial impedance surface antenna design and simulation", 2010 Proceedings of the 2010 Antenna Applications Symposium, pp. 288-303.
Fong, B.H.; Colburn, J.S.; Ottusch, J.J.; Visher, J.L.; Sievenpiper, D.F., "Scalar and Tensor Holographic Artificial Impedance Surfaces", *IEEE Trans. Antennas Prop.*, vol. 58, No. 10, pp. 3212-3221, 2010.
Ottusch, J.J.; Kabakian, A.; Visher, J.L.; Fong, B.H.; Colburn, J.S.; and Sievenpiper, D.F.; "Tensor Impedance Surfaces", AFOSR Electromagnetics Meeting, Jan. 6, 2009.
PCT International Search Report and Written Opinion (ISR and WO) mailed on Apr. 3, 2014 from related PCT Application No. PCT/US2013/050412.
Noujeim, Karam M. Fixed-frequency beam-steerable leaky-wave antennas. Ph. D. Thesis. Department of Electrical and Computer Engineering University of Toronto. National Library of Canada, 1998.
Sazegar, M. et al., Beam Steering Transmitarrav Using Tunable Frequency Selective Surface With Integrated Ferroelectric Varactors, IEEE Transactions on Antennas and Propagation, Aug. 13, 2012. vol. 60, No. 12, pp. 5690-5699, ISSN 0018-926X.
From U.S. Appl. No. 13/242,102, Office Action mailed on Mar. 4, 2014.
From U.S. Appl. No. 13/242,102 (now published as US 2013-0285871), Office Action mailed on Jul. 18, 2014.

* cited by examiner

Fig. 4
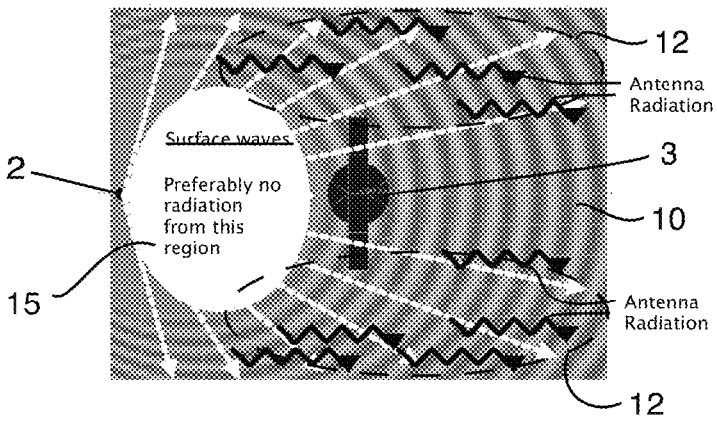
Fig. 5
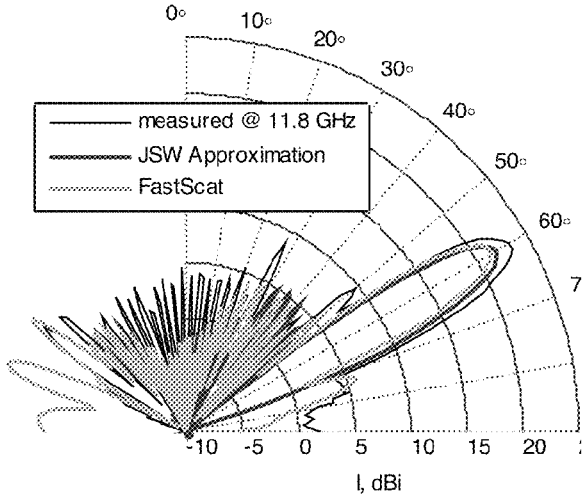
AISA simulations and Measurement
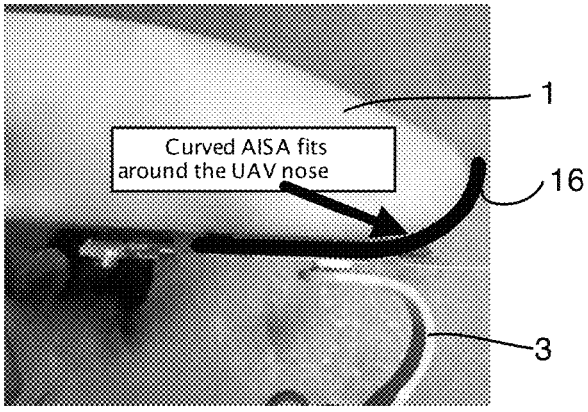
Fig. 6a

CONFORMAL ANTENNAS FOR MITIGATION OF STRUCTURAL BLOCKAGE

STATEMENT REGARDING FEDERALLY SPONSORED RESEARCH OR DEVELOPMENT

This invention was made under US Government contract No. W15P7T-06-9-P011 and therefore the US Government may have certain rights in and to this invention.

CROSS REFERENCE TO RELATED APPLICATIONS

U.S. patent application Ser. No. 13/242,102 filed on the same date as this application and titled "Conformal Surface Wave Feed", which is hereby incorporated herein by reference.

TECHNICAL FIELD

This invention relates to the placement of antennas on vehicles such as aircraft (airplanes, including unmanned aerial vehicles (UAVs), and airships), land craft (automobiles, trucks, etc.) and sea craft (boats, ships, etc.) that have limited space for mounting antennas and have (or will have) obstructions that will degrade the radiation patterns of conventional antennas.

BACKGROUND

FIG. 1*a* shows the fuselage of an aircraft fuselage. It is desirable to mount an antenna on the underside of the fuselage behind the landing gear. However, at least portions of the landing gear (particularly its support strut) block the antenna radiation in the forward direction.

There are many other instances where some element protrudes (or could protrude) from the body of a vehicle which protruding element interferes or obstructs (or could interfere or obstruct) RF reception to and/or transmission from an antenna also on the body of the vehicle. If the vehicle is currently being designed, perhaps it will be possible to move either the antenna or the interfering or obstructing element. Other times, that cannot be done and if the vehicle has already been built it can be very inconvenient to do so, if not impossible to do so. This invention relates to techniques which can be used to mitigate the effects of such elements which otherwise can interfere or obstruct RF reception to and/or transmission from an antenna also on the body of the vehicle. An interfering or obstructing element is generically referred to as a blockage herein.

The prior art includes:

D. J. Gregoire and J. S. Colburn, "Artificial impedance surface antenna design and simulation", 2010 Antenna Applications Symposium, pp. 288-303, the disclosure of which is hereby incorporated herein by reference.

Fong, B. H.; Colburn, J. S.; Ottusch, J. J.; Visher, J. L.; Sievenpiper, D. F., "Scalar and Tensor Holographic Artificial Impedance Surfaces", *IEEE Trans. Antennas Prop.*, vol. 58, pp. 3212-3221, 2010, the disclosure of which is hereby incorporated herein by reference.

Ottusch, J. J.; Kabakian, A.; Visher, J. L.; Fong, B. H.; Colburn, J. S.; and Sievenpiper, D. F.; "Tensor Impedance Surfaces", AFOSR Electromagnetics Meeting, Jan. 6, 2009, the disclosure of which is hereby incorporated herein by reference.

Artificial impedance surface antennas (AISA) are formed from modulated artificial impedance surfaces (AIS). The AIS are typically fabricated using a grounded dielectric topped with a grid of metallic patches. The article by Fong presents a detailed description of the methods used for designing and fabricating linearly and circularly polarized AISAs using scalar and tensor impedance maps, respectively.

BRIEF DESCRIPTION OF THE INVENTION

In one aspect the present invention provides a method of mitigating adverse transmission and/or reception effects that an obstruction would otherwise have upon a RF signal to be transmitted or received, the RF signal being available at a feed point. The obstruction is spaced from the feed point in a direction of desired transmission or reception. The method includes disposing an artificial impedance surface adjacent the feed point and the obstruction, and tuning or otherwise causing the artificial impedance surface (i) to have a spatially constant impedance function in a constant impedance region at least immediately adjacent the feed point and (ii) to have a spatially non-constant impedance function in one or more regions spaced from the feed point and closer to the obstruction.

In another aspect the present invention provides a method of radiating RF energy available from a feed point disposed on object having a obstruction which would normally interfere with radiation of the RF energy at said feed point, the method including emitting RF energy as surface waves on an artificial impedance surface from said feed point, the artificial impedance surface having a first regions with a first surface impedance function which supports said surface waves moving away from said feed point and having a second region with a second surface impedance function which causes said surface waves to leak or launch off the artificial impedance surface as the radiation of said RF energy away from said artificial impedance surface.

In yet another aspect the present invention provides an apparatus for mitigating an effect of a RF obstruction upon a RF signal emitted by a RF feed point, the apparatus including an artificial impedance surface relative having the RF feed point disposed or adjacent the artificial impedance surface and with the RF obstruction being disposed on or adjacent the artificial impedance surface, the artificial impedance having an essentially spatially constant impedance function in a region of the artificial impedance surface bounded by the RF feed point and the RF obstruction and with a spatially varying impedance function in regions not bounded by the RF feed point and the obstruction.

In still yet another aspect the present invention provides an artificial impedance surface antenna comprising an artificial impedance surface disposed adjacent a structural element which acts as a RF block, the artificial impedance surface having an impedance modulation that routs surface waves released upon the artificial impedance surface around said obstruction and into a radiating region unaffected by the obstruction.

BRIEF DESCRIPTION OF THE DRAWINGS

FIG. 4 is a plan view of an AIS with an obstruction more or less disposed in or adjacent the middle of it.

FIG. 5 compares a couple of simulation methods to each other and to some measured data for an AISA designed to radiate at 60° off normal at 12 GHz.

FIG. 6*a* shows a cross section of a model of the nose of an aircraft with a curved line designating the profile of the test version of the curved AIS.

DETAILED DESCRIPTION

Figure 1A:
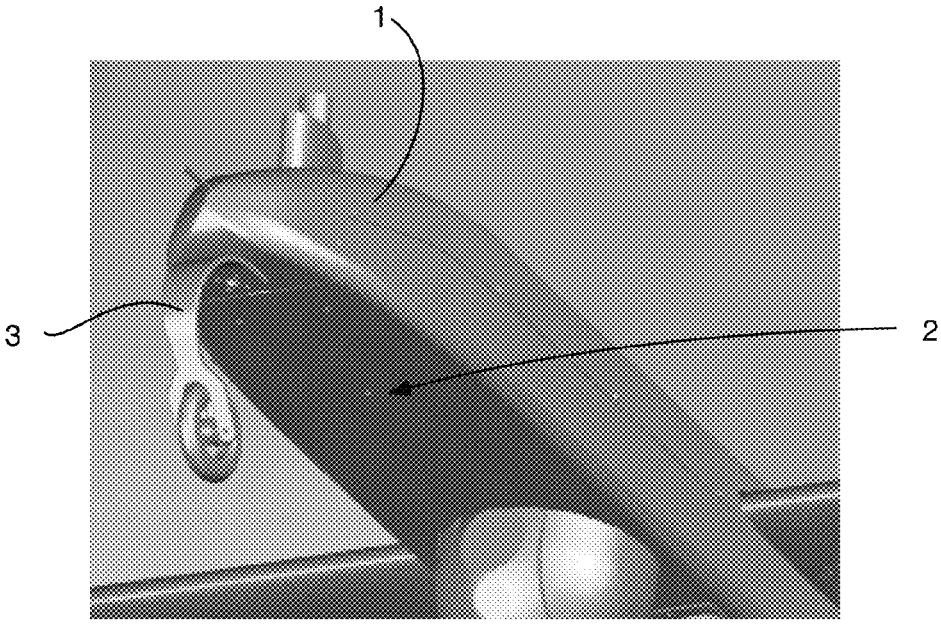
FIG. 1*a* depicts the fuselage of an aircraft. Antennas mounted on the fuselage underbelly will have their forward-directed radiation blocked by the landing gear strut.

As indicated above, FIG. 1*a* shows the fuselage 1 of an aircraft. It is desirable to mount an antenna 2 on the underside of the fuselage behind the strut 3 which supports a landing gear wheel. However, the landing gear strut 3 will block radiation from antenna 2 in a forward direction (towards the landing gear strut 3). While FIG. 1*a* shows a strut 3 causing blockage, there are any number of objects which can protrude from a vehicle, such as the aircraft shown in FIG. 1*a*, which can hinder or obstruct the transmission and/or reception of RF energy at antenna 2, for example. While it is a landing gear strut 3 which is the particular object causing RF obstruction here, the obstructing object will often be referred to simply as an obstruction herein, it being understood that any manner of objects blocking or hindering the transmission and/or reception of FR energy can be mitigated using the technology disclosed herein.

Figure 1B:
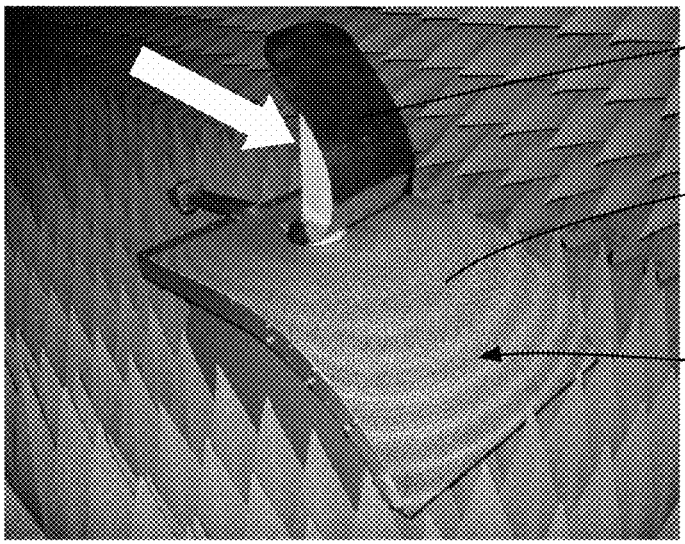
FIG. 1*b* depicts a model intended to simulate the portion of the aircraft shown in FIG. 1*a* between the antenna, the landing gear strut and the region immediately in front of the landing gear strut to test mitigation of the obstruction caused by the strut relative to the antenna's feed point by employing a surface-wave waveguiding region in front of the strut.
Figure 2:
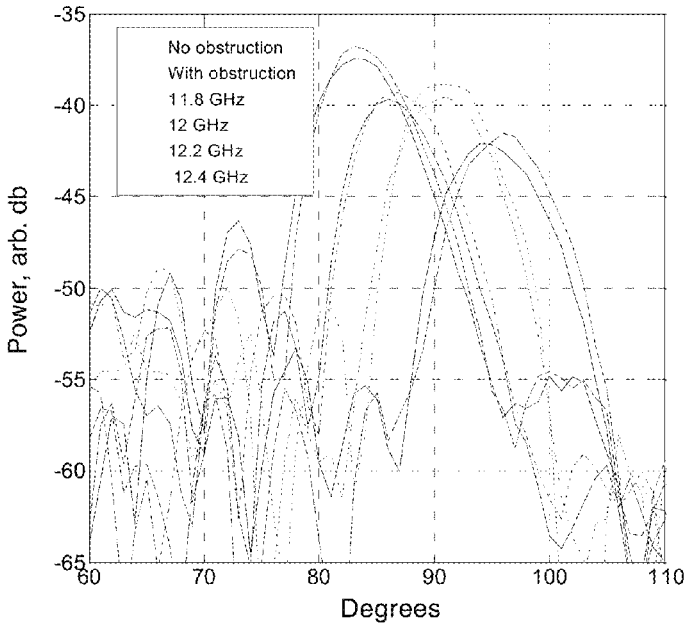
FIG. 2 depicts the measured radiation patterns of the antenna shown in FIG. 1*b*, the antenna being the curved surface due to the presence of a surface-wave waveguiding region in front of the strut, the feed to the antenna is the rectangular waveguide mounted behind the strut. The radiation intensity was measured with and without the strut obstruction in place (solid and dashed lines respectively) and for different frequencies (represented by different levels of black and gray). For each frequency tested, the radiation intensity with the strut in place (in solid lines) very closely follows the radiation intensity without the strut in place (in dashed lines). The angle θ is with reference to the flat portion of the AIS 10, with θ=0° being normal to the flat portion of the AIS 10 and with θ=90° pointing forward parallel to the flat portion of the AIS 10.

FIG. 1*b* is representation of a mockup or prototype of the forward portion of the fuselage 1 of an aircraft to test if the AIS 10 of the present invention will mitigate the blockage caused by strut or obstruction 3 in that forward portion. Its design is meant to generically represent the front portion of an aircraft fuselage 1. The depicted elliptical variations 4 pictorially represent a surface-wave impedance modulation that characterizes AIS 10. The shapes of the depicted elliptical variations 4 will depend upon the shape and size of the obstruction 3 as well as its location relative to feed point 2. The variations are dependent on: (1) the desired antenna properties, including radiation angle and frequency, (2) the material properties of the substrate and its thickness, and (3) the period, shape and mean size of the metallic patches that form the AIS. All of this information is included in the equations (1)-(3) below. The elliptical variation and the light and dark bands seen in the figures are formed with metallic patches of varying size. The larger the patch, the higher the surface-wave impedance. The darker bands in the depictions are caused by larger patches on the light underlying dielectric substrate. The results of testing, see FIG. 2, show that the obstruction 3 has little effect on the radiation pattern over a broad range of frequencies when a properly designed AIS 10 is utilized to move the radiation to be launched around the RF obstacle presented by the obstruction 3. The prototype AISA 10 as measured on the fuselage mockup shows less than a 1 dB attenuation due to the obstruction caused by the strut. See FIG. 2 which depicts the radiation intensity is measured with and without the strut obstruction in place (solid and dashed lines respectively) and for different frequencies (represented by different levels of black and gray). For each frequency tested, the radiation intensity with the strut in place (in solid lines) very closely follows the radiation intensity without the strut in place (in dashed lines).

Figure 3A:
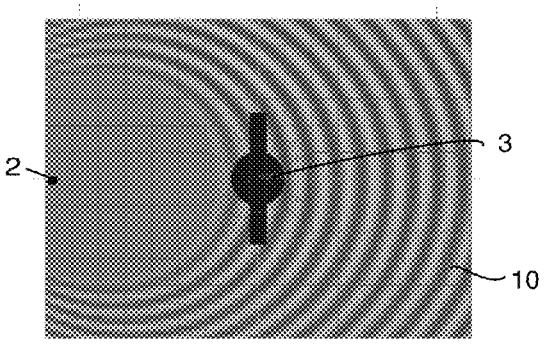
FIG. 3*a* is a bottom up view of the ASIA where a conventional antenna has been replaced with a surface-wave feed that feeds a surface wave onto an AIS 10. The AIS 10 has a modulated impedance (indicated by the gray variation) that radiates into a desired radiation pattern. However, the impedance is not modulated until after the surface wave propagates into regions where the gear strut 3 obstruction will not affect the radiated energy.
Figure 3B:
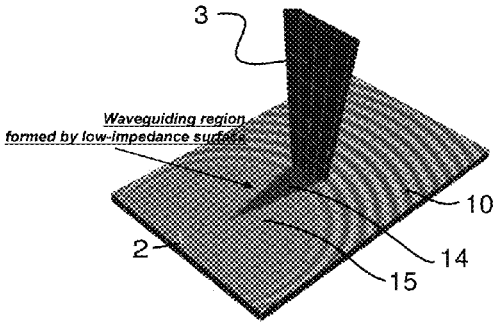
FIG. 3*b* depicts how the AIS is preferably enhanced by adding a surface-wave waveguiding region that guides the surface wave around the obstruction and prevents any of the surface wave energy from being attenuated by the obstruction caused by the strut. The surface waves propagate past the obstruction caused by the strut to the radiation region.

FIG. 3*a* illustrates conceptually the method the invention uses to mitigate the antenna blockage problem discussed with reference to FIG. 1*a*. The antenna originally used on the aircraft 1 is replaced with a Artificial Impedance Surface Antenna (AISA) which preferably conforms to the shape of the aircraft 1. The AISA function as an antenna. The feed is a device located at feed point 2 that launches the surface waves across the antenna surface formed by the AISA. The device at the feed point can be any number of things: a monopole antenna, a waveguide, or microstrip line feed, for example. The surface waves propagate across an impedance modulation (represented by the elliptical-looking patterns 4 in FIGS. 1*b* and 3*a*) formed by varying the size of metallic patches on the dielectric substrate on the AIS 10 until they reach one or more radiation region(s) 12 that is(are) not affected by the gear strut obstruction 3, since the antenna's radiation region is effectively moved in front of the strut or obstruction 3 (an area, for example, which is not affected by the gear strut obstruction 3). See the dashed-line ovals identified with numeral 12 in FIG. 4 which more or less identify the radiation region 12 of the AIS 10 of that embodiment. FIG. 3*b* depicts an embodiment that is further enhanced by adding a surface-wave waveguiding region 14 that guides the surface waves around the obstruction 3 and prevents any of the surface wave energy from being attenuated by the obstruction. FIG. 3*b* shows depicts an embodiment of the invention that incorporates the waveguiding region 14.

Artificial Impedance Surface Antennas (AISA)

Artificial impedance surface antennas (AISA) are realized by launching a surface wave across the AIS 10, whose impedance is spatially modulated across the AIS 10 according a function that matches the phase fronts between the surface wave on the AIS 10 and the desired far-field radiation pattern. The resulting radiation pattern may be a pencil beam whose directivity, angle, beam width and side lobes are determined the details of the AISA geometry and its electrical properties. The AISA is an antenna since it launches electromagnetic radiation from all points on the its surface where there is the impedance modulation. See regions 12 in FIG. 4. The AISA discussed above was designed to work in the Ku frequency band and could certainly be designed to work in other frequency bands as desired.

It is desirable to direct the radiation pattern from the antenna feed point 2 as close as possible to the plane of the fuselage's bottom, thus overcoming the radiation pattern lift caused by finite and curved ground planes. The approach used is conceptually presented in FIG. 4 which shows an AIS 10 with an obstruction 3 in the middle of it. The feed 2 launches surface waves across the AIS 10. When the surface waves reach the modulated impedance region designated by the light and dark bands on the AIS 10, they leak off the surface to form the antenna radiation. The effects of the obstruction 3 are mitigated by forming a non-radiative, constant-impedance region 15 adjacent the feed point 2 and, in some embodiments, in front of the obstruction 3. The AIS 10 is modulated for radiation only in those areas where the obstruction 3 does not impede a line of sight between the AIS 10 and the desired radiation region 12 (on the surface of AIS 10, the obstruction 3 is limited to the depicted dark circular region—the obstruction 3 widens as it moves away from the surface of the AIS 10 as can be seen in FIG. 3*b*). In the embodiment of FIG. 4, a small portion of the surface waves is intercepted by the obstruction 3 (the depicted dark circular region at the based of obstruction 3). FIG. 3*b* shows a technique to enhance blockage mitigation by creating a low-impedance, surface-wave guide (represented by the dark triangular region 14) in front of the obstruction 3 that guides the surface waves around the obstruction 3 to the radiating region 12 not affected by the obstruction 3 (for example, where radiation is showing as occurring in FIG. 4 by the black sinusoidal waves which are launched in region 12). The waveguide region 14 is formed analogous to dielectric waveguides that consist of a relatively high-index material surrounded by a relatively low index material.

The basic principle of AISA operation is to use the grid momentum of the modulated AIS to match the wavevectors between a surface-wave and a plane wave. In the one-dimensional case, the condition on the impedance modulation is $$k_p = \frac{2\pi}{\lambda_P} = k_o(n_o - \sin\theta_o) \quad \text{(Eqn. 1)}$$

where $k_o$ is the radiation's free-space wavenumber at the design frequency, $\theta_o$ is the angle of the desired radiation with respect to the AIS normal, $k_p=2\pi/\lambda_p$ is the AIS grid momentum where $\lambda_p$ is the AIS modulation period, and $k_{sw}=n_o k_o$ is the surface wave's wavenumber, where $n_o$ is the surface wave's refractive index averaged over the AIS modulation.

The AIS modulation for the one-dimensional AISA radiating at the angle $\theta_o$ and the wavenumber $k_o$ can be expressed as periodic variation in the surface-wave propagation index ($n_{sw}$). In the simplest case, it is sinusoidal.

$$n_{sw}(x)=n_o+dn\cos(k_p x) \quad \text{(Eqn. 2)}$$

where dn is the modulation amplitude. For AISA surfaces of arbitrary shape, the modulation of Eqn. 2 can be generalized as $$n_{sw}(\vec{r})=n_o+dn\cos(k_o n_o r-\vec{k}_o\cdot\vec{r}). \quad \text{(Eqn. 3)}$$

where $\vec{k}_o$ is the desired radiation wave vector, $\vec{r}$ is the three-dimensional position vector of the AIS, and r is the distance along the AIS from the surface-wave source to $\vec{r}$ along a geodesic on the MS surface. For a flat surface, $r=\sqrt{x^2+y^2}$.

Figure 6B:
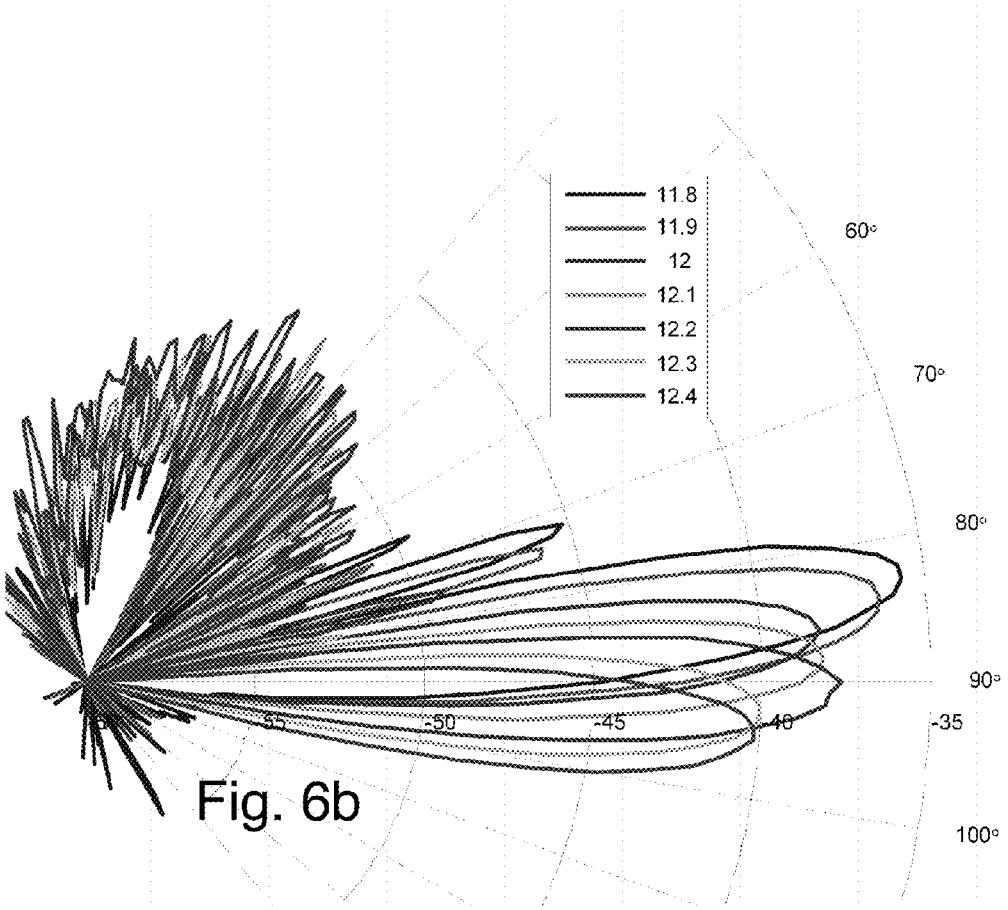
FIG. 6*b* presents some representative measured radiation patterns for the curved AIS of FIG. 6*a* for various frequencies spanning the range 11.8 to 12.4 GHz and 82° to 95° off normal.

FIG. 5 compares two simulation methods to each other and to some measured data for an AISA designed to radiate at 60° off normal at 12 GHz. AISAs excited by TM-mode surface waves are limited in their angular range to about ~75° declination from the surface normal because the surface currents are parallel to the direction of propagation. The AISA that can radiate close to 90° off normal by curving the AIS 10. In terms of placing the AIS 10 on the fuselage of an aircraft, if a forward landing gear strut is causing the obstruction, then it is very convenient to curve the AIS 10 to follow the curving aircraft fuselage normally found at the front of the aircraft. An AISA can readily be designed with curvature by applying the generalized impedance map of Eqn. 3. If the AIS 10 is simply curved in a single plane, then it can be easily fabricated by printing the impedance map on a flat substrate and then bending it around a form or mold. Fabricating AISAs with a complex curvature such as a spheroid, ellipsoid or paraboloid requires more extensive design and fabrication processes. FIG. 6*a* shows a cross section of the fuselage 1 with a curved line 16 designating the profile of the test version of the curved AIS 10. If the AIS 10 were planar, it would be impossible to direct radiation 90° off normal. By curving the AIS 10, the feed point 2 preferably is still on the planar portion behind the obstruction 3, but the upward curving portion is now a radiation aperture that can efficiently radiate in the forward direction. Some representative measured radiation patterns from such an AISA are shown in FIG. 6*b* for various frequencies spanning the range 11.8 to 12.4 GHz and 82° to 95° off normal.

Surface-Wave Waveguides

As is discussed above with reference to FIG. 3*a*, the AIS 10 can be further enhanced by adding a Surface-wave WaveGuide (SWG) region 14 thereto. A SWG region 14 offers further advantages for mitigating antenna pattern blockage due to structural elements (such as obstruction 3). The SWG principle is analogous to making a dielectric waveguide where the wave is guided in a high index region surrounded by a low index region. Similarly, an SWG is formed by creating regions of varying surface-wave index. Utilizing the simple SWG region 14 seen in FIG. 3*b* with an AIS 10 can be very effective at reducing the effect of obstruction 3 to a minimum. The SWG region 14 is a low-index region that excludes the surface waves. The impedance in the SWG region 14 is lower than the neighboring region 15, and this tends to reflect surface waves to reflect off the boundary between the regions 14 and 15. The SWG region 14 is triangularly-shaped region whose base has a width approximately equal to the width of the obstruction 3 at the surface of the region 14 and whose apex points towards feed point 2. The surface waves are guided around the SWG region 14 and thereby avoid being intercepted by the obstruction 3. They continue to propagate past the obstruction 3 where they can radiate unimpeded from the radiating regions 12 (see FIG. 4) in front and to the sides of the obstruction 3. The low-impedance region 14 is preferably realized with a bare dielectric. There are other methods of obtaining a low-impedance region 14: (1) the thickness of the dielectric can be reduced in the SWG region 14 as this would decrease the impedance even farther and/or (2) a material with lower permittivity than the surrounding region can be used in region 14.

The terms surface-wave impedance and surface-wave index are related by a simple formula $n=(1+Z^2)^{1/2}$ where n is the index and Z is the surface wave impedance. A high index corresponds to high impedance, and vice versa. The term impedance herein refers to surface-wave impedance.

A second principle used in blockage mitigation is to locate the radiation aperture 12 so that it is not affected by the obstruction 3. This is illustrated in FIG. 3*a* which shows a non-radiating, constant impedance region 15 in front of the obstruction. Surface waves move through this region without radiating until they pass the obstacle 3 and reach the radiation aperture region 12. So there are two effects of the obstruction 3 that are being independently mitigated. One is that obstruction 3 blocks where radiation can be emitted from the AIS 10. Second, it blocks surface waves traveling along the AIS 10. The SWG is used to prevent the surface waves from hitting the portion of the obstruction that is sitting on the surface. Putting a non-radiative region 12 in front of the obstruction 3 prevents radiation form being created in a place where it will be blocked by the obstruction 3 extending above the AIS 10. When the radiation is emitted from the region 12 located in front of the obstruction 3, then there is no blockage to radiation to be emitted in the forward direction (in the direction of the sinusoidal waves which are launched in region 12 as depicted in FIG. 4).

The shape and impedance-profile of the SWG region 14 was chosen as one way of demonstrating its effect on improving AISA blockage mitigation. The results show that its effects are beneficial and it is advantageous to explore and optimize such structures, especially to optimize it for specific AISA platform applications and geometries of the feed point 2, the obstruction 3 and the shape of the surface between them. So while the triangular shape depicted for region 14 is clearly beneficial, other shapes for region 14 may yield further improvement or modifying the depicted triangular shape of region 14 may yield further improvement.

Simulation of Blockage Mitigation

Figure 7A:
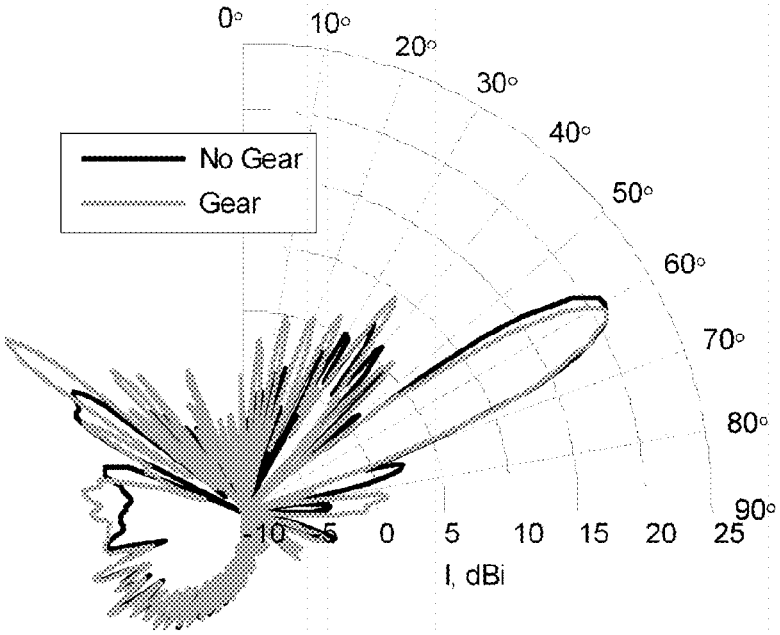
FIGS. 7*a* and 7*b* are graphs which compare simulated radiation patterns given the obstruction with using an AISA to mitigate the obstruction (FIG. 7*a*) and without using an AISA to mitigate the obstruction (FIG. 7*b*).
Figure 7B:
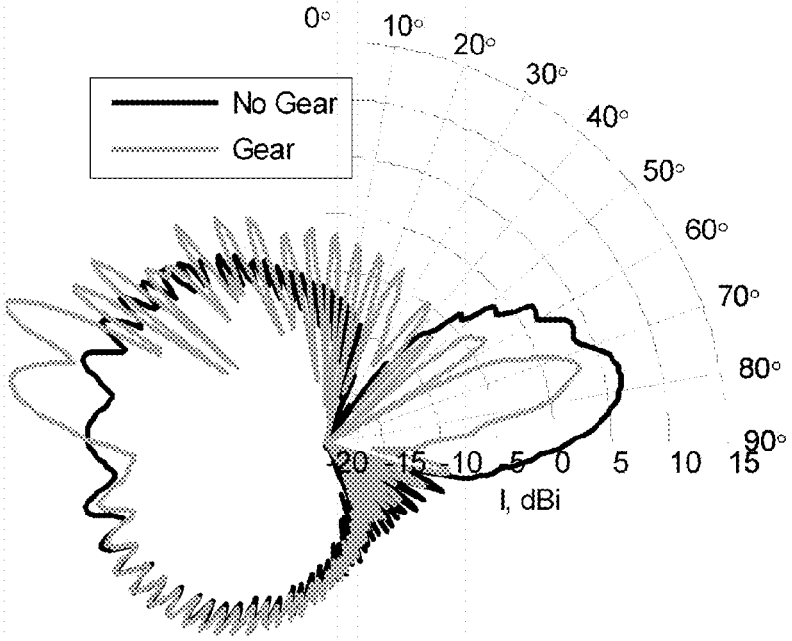

Simulations were used to demonstrate the ability of the SWG techniques outlined above to mitigate antenna blockage. FIGS. 3*a* and 3*b* show two AISA configurations (one without region 15 and one with region 15) which were simulated using software. In these simulations, the obstruction 3 is represented by a PEC rectangular obelisk 10 cm in width and 30 cm high. FIG. 7*a* compares simulated radiation patterns for an AISA with and without the obstruction 3 caused by the idealized landing "gear". For comparison, FIG. 7*b* shows simulated radiation patterns for a dipole mounted on a Perfect Electrically Conducting (PEC) surface (that is, without the AIS 10) with and without the same obstruction 3. The obstacle has a pronounced effect on the dipole on the PEC, but the AIS 10 with SWG region 15 blockage mitigation is only affected slightly.

Measurements of Blockage Mitigation

AISA technology for blockage mitigation was characterized with measurements of flat and curved AISAs with and without the low-impedance SWG region 15. The radiation patterns were measured with and without a metal structure emulating the landing gear strut 3 seen in FIGS. 1*a*, 1*b* and 6*a* in order to characterize the effectiveness of the mitigation region 15. In general, the effect of the blockage was limited to a reduction of only 0.5 to 2 dB. In one case, the curved AIS 10 showed no reduction in radiation intensity when radiating at 90°. Compare that to the pronounced effects of the strut 3 on a waveguide or dipole feed on PEC plates with the same geometry as the AIS.

Figure 8A:
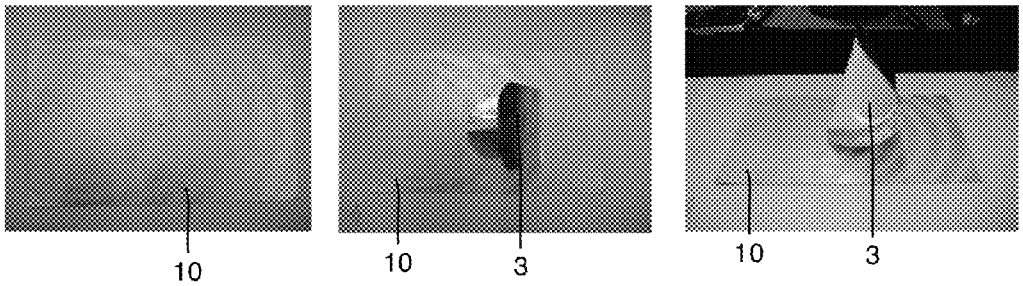
FIGS. 8*a* and 8*b* are representation of flat AISAs. In the case of FIG. 8*a*, from left to right are shown (i) the AIS alone, (ii) the flat AIS with the obstruction modeled thereon, and (iii) a perspective view of (ii). In the case of FIG. 8*b*, the representations from left to right are as in the case of FIG. 8*a*, but the flat AIS in this figure also has a SWG region.
Figure 8B:
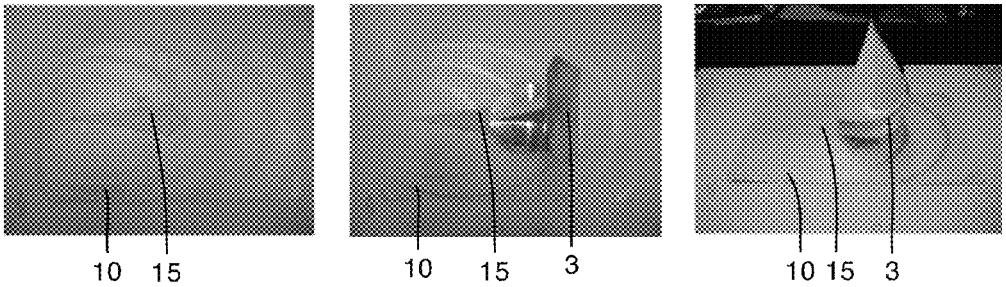
Figure 11A:
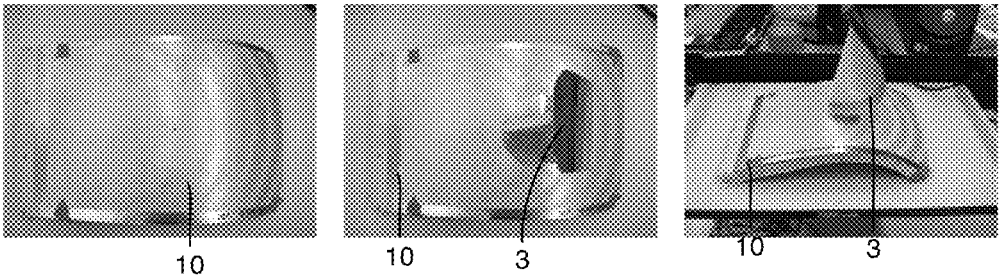
FIGS. 11*a* and 11*b* are representation of curved AISAs. In the case of FIG. 11*a*, from left to right are shown (i) the curved AIS alone, (ii) the curved AIS with the obstruction modeled thereon, and (iii) a perspective view of (ii). In the case of FIG. 11*b*, the representations from left to right are as in the case of FIG. 11*a*, but the curved AIS in this figure also has a SWG region.
Figure 11B:
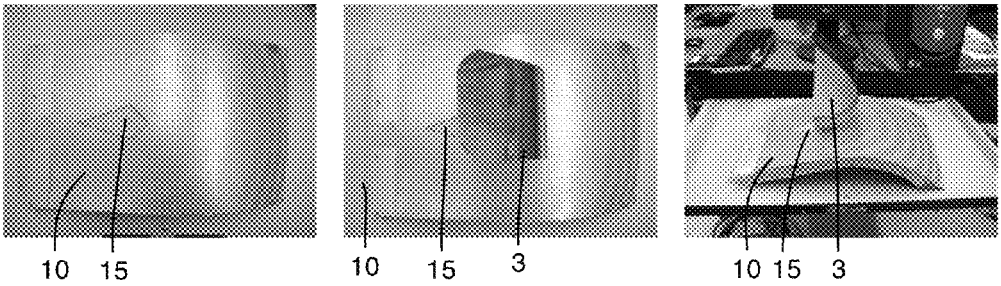

The flat AISAs, with (see FIG. 8*b*) and without (see FIG. 8*b*) the SWG region 15, and with and without the strut 3, are shown in FIGS. 8*a* and 8*b*. FIGS. 11*a* and 11*b* show the same views with the curved AIS 10. The AISA feed 2 is a waveguide which is centered along the short side of the left side of AIS 10 in FIGS. 8*a*, 8*b*, 11*a* and 11*b*. The feed 2 is directed directly at the strut 3. This feed 2 is an expedient and suitable method for verifying and characterizing AIS 10 performance and radiation patterns; it is not meant to represent an optimum feed system. A preferred feed 2 would comprise a feed that is conformal to the surface. See U.S. patent application Ser. No. 13/242,102 filed on the same date as this application and titled "Conformal Surface Wave Feed", which is hereby incorporated herein by reference.

The flat AIS 10 depicted in FIGS. 8*a* and 8*b*, has its radiation measurements shown in FIGS. 9*a*-9*b* and 10*a*-10*d*. Its far-field radiation patterns were measured with and without obstruction 3 (see FIG. 9*a*). When radiating at 60°, the obstruction 3 attenuates the peak intensity by 2 dB. A 2×5 inch surface-wave guiding region 15 depicted in FIG. 8*b*, was then integrated into that AIS 10 and the measurements were repeated (see FIG. 9*b*). The obstruction 3 attenuates the SWG-AISA's peak intensity by 1 dB.

Figure 9A:
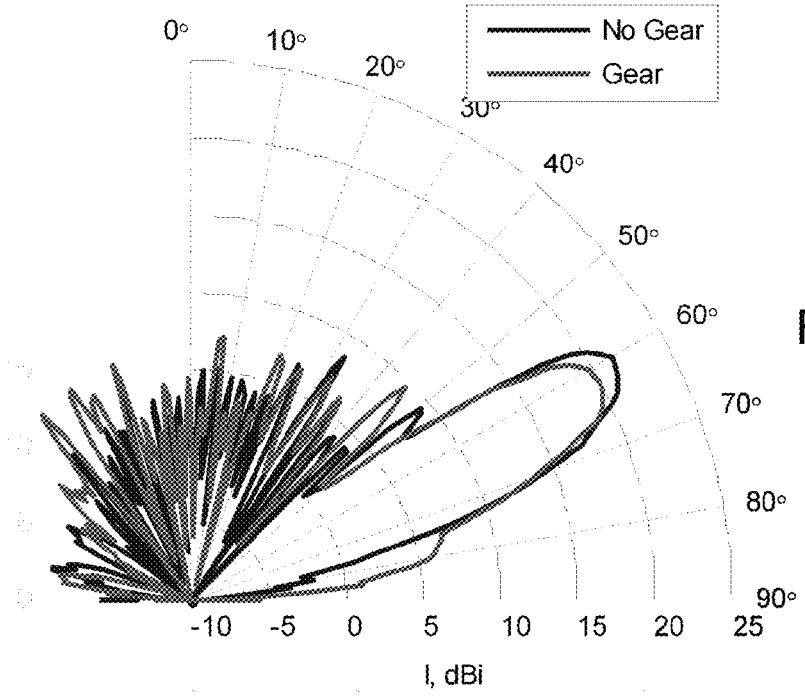
FIGS. 9*a* and 9*b* are graphs of radiation measurements for the AISA with flat AIS as depicted by FIGS. 8*a* and 8*b*, respectively.
Figure 9B:
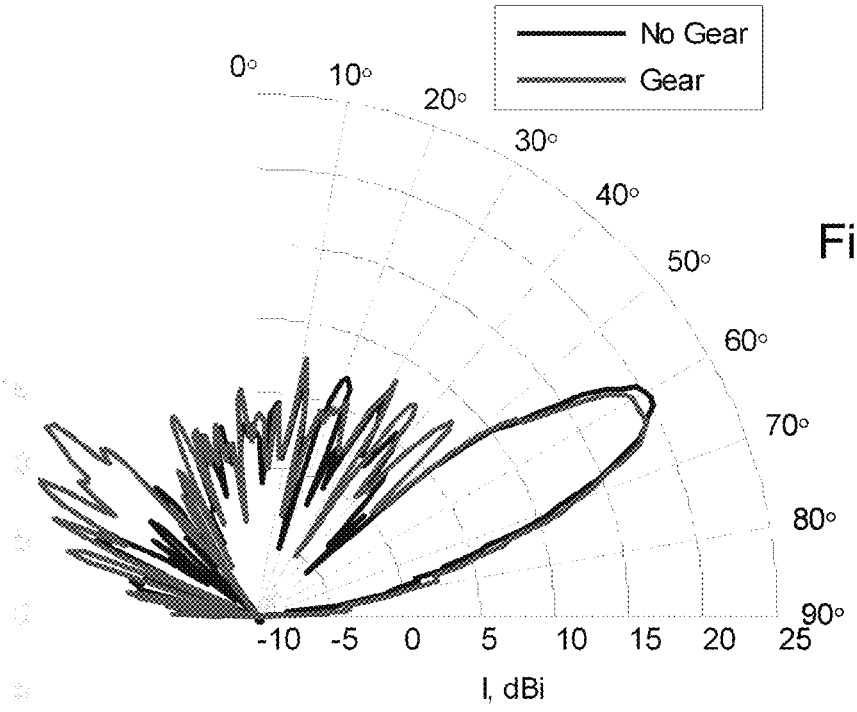
Figure 9C:
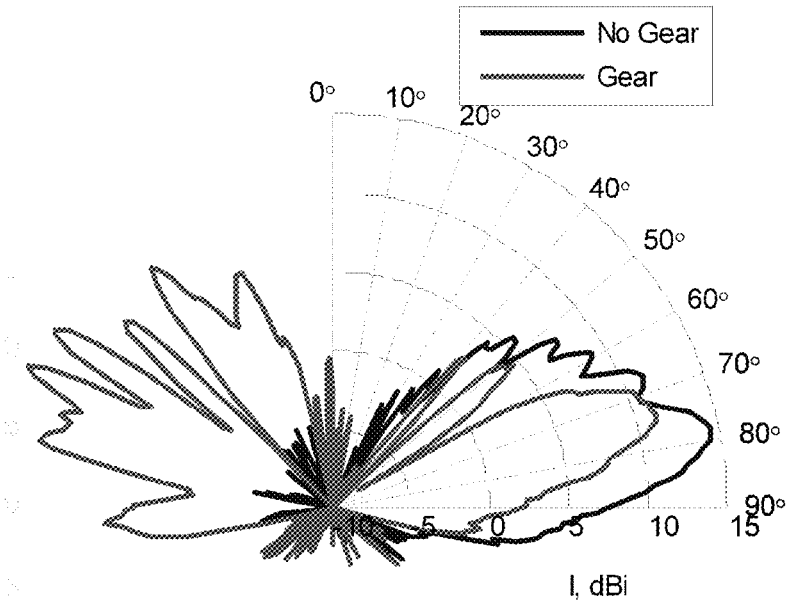
FIGS. 9*c* and 9*d* are graphs of radiation measurements similar to the graph of FIGS. 9*a* and 9*b*, but instead of measuring with the AISA in place, the graphs are based using a metal plate of the same size and shape as the AIS of FIGS. 8*a* and 8*b*.
Figure 9D:
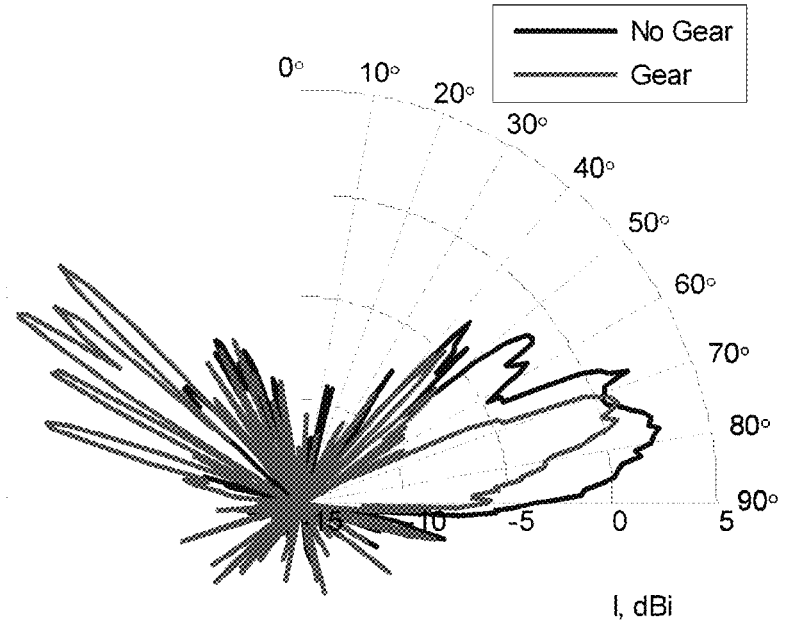

For comparison, FIGS. 9*c* and 9*d* show the same measurements performed on metal plate of the same size and shape as the AIS 10 of FIGS. 8*a* and 8*b*, using either a waveguide or dipole feed 2. The strut 3 is placed in the same location relative to the feeds as in the AISA measurements depicted by FIGS. 9*a* and 9*b*. It can be seen that without the AIS 10 on the metal plate, the blockage of the strut 3 causes drastic changes to the far field radiation patterns. In fact, the scattering of the waveguide-fed plate with the strut attached dominates the radiation pattern. In the case of both feed arrangements, the peak intensity with the strut is in the backward direction, indicating a strong reflection of radiation by the strut 3.

Figure 10A:
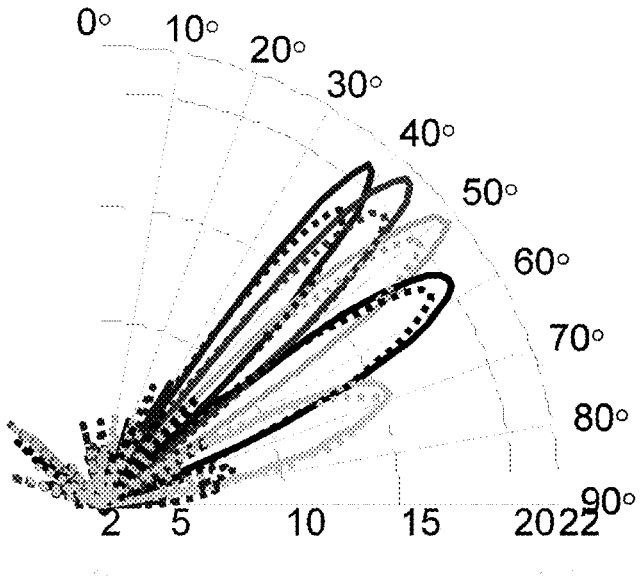
FIG. 10*a* is a plot of radiation patterns at several frequencies in range from 10 GHz to 12.5 GHz for the AIS embodiment with the SWG region.
Figure 10B:
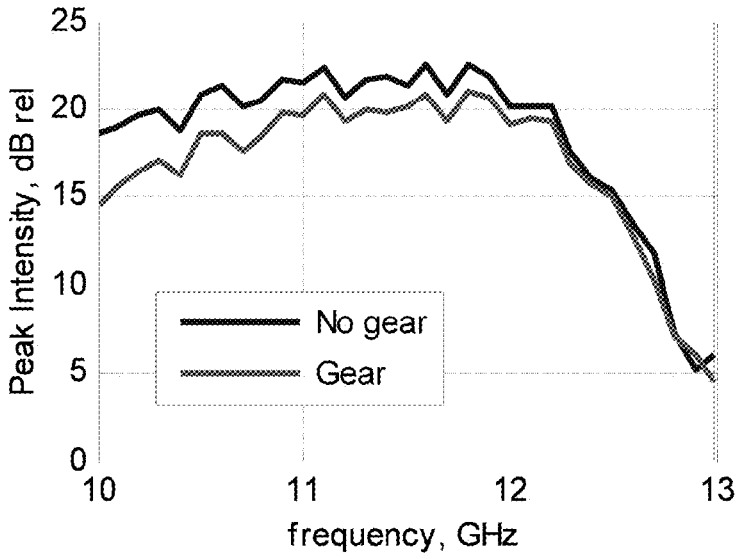
FIG. 10*b* shows the peak intensity for the blocked (gear) and unblocked (no gear) cases for the AIS embodiment with the SWG region.
Figure 10C:
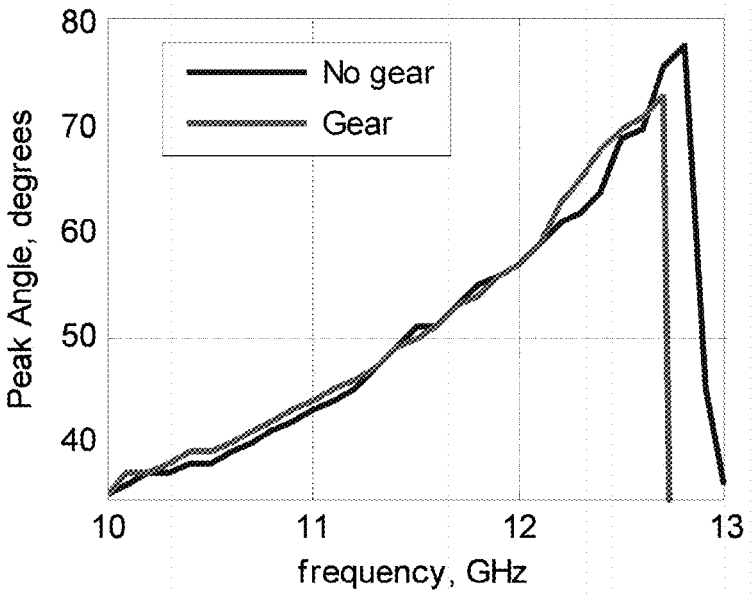
FIG. 10*c* shows how the peak angle scans with frequency for both the blocked (gear) and unblocked (no gear) cases for the AIS embodiment with the SWG region.
Figure 10D:
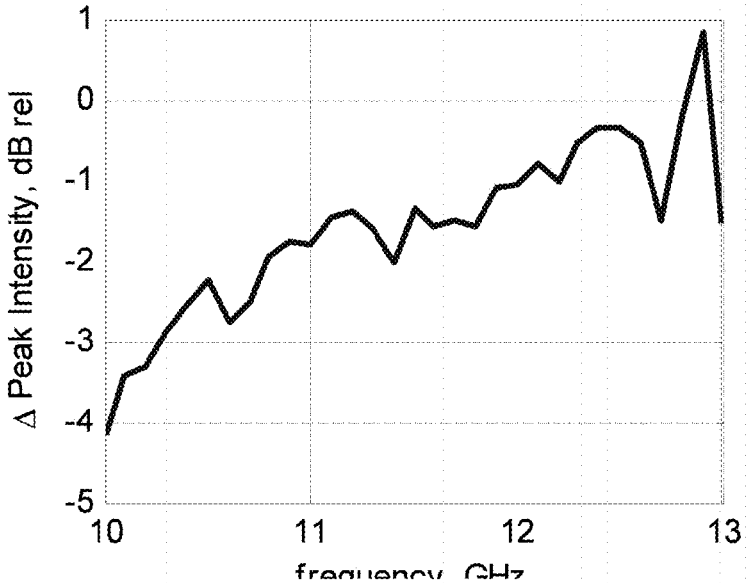
FIG. 10*d* plots the difference in peak intensity showing that it drops uniformly as the frequency approaches the design frequency of 12 GHz for the AIS embodiment with the SWG region.

The effectiveness of the AIS 10 embodiment with the SWG region 15 is consistent across the frequency range where the intensity drops off by several dB. Radiation patterns at several frequencies in this range are plotted in FIG. 10*a*. FIG. 10*c* shows how the peak angle scans with frequency for both the blocked (gear) and unblocked (no gear) cases. There is little difference between the two cases. FIG. 10*b* shows the peak intensity for the blocked (gear) and unblocked (no gear) cases and FIG. 10*d* plots the difference in peak intensity showing that it drops uniformly as the frequency approaches the design frequency of 12 GHz.

Measurements of Curved AISAs

Figure 12A:
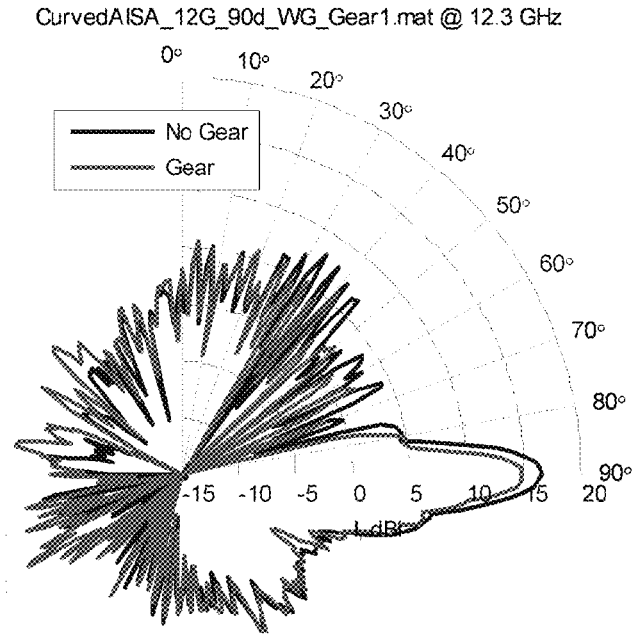
FIGS. 12*a*-12*d* and FIGS. 13*a*-13*d* are similar to FIGS. 9*a*-9*d* and 10*a*-10*d*, but are for the curved AIS of FIGS. 11*a* and 11*b* as opposed to the flat AIS of FIGS. 8*a* and 8*b*.
Figure 12B:
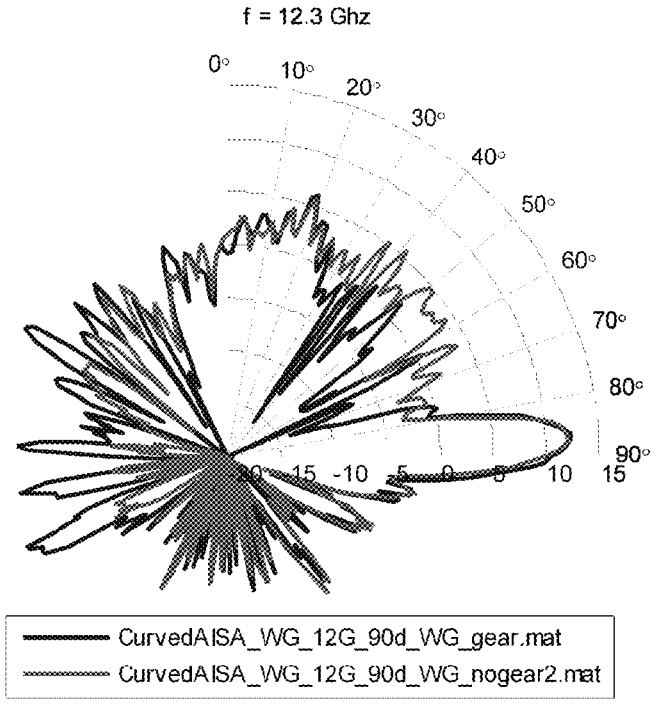
Figure 12C:
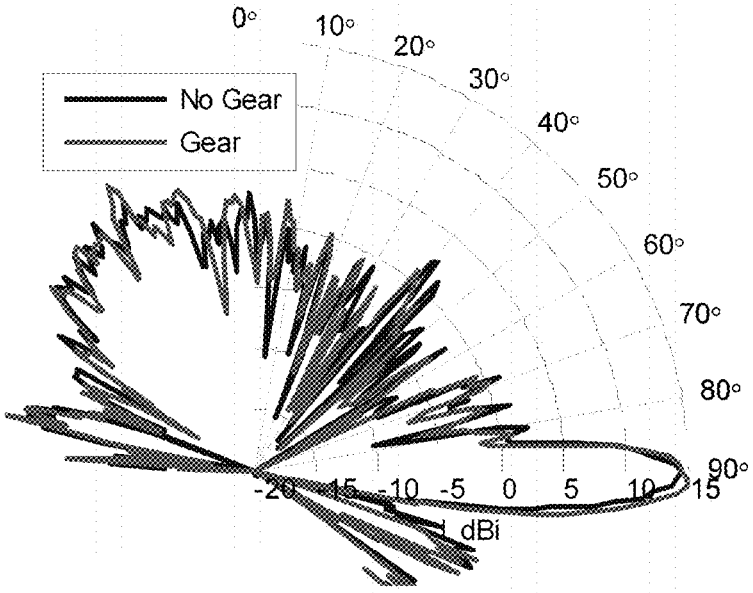
Figure 12D:
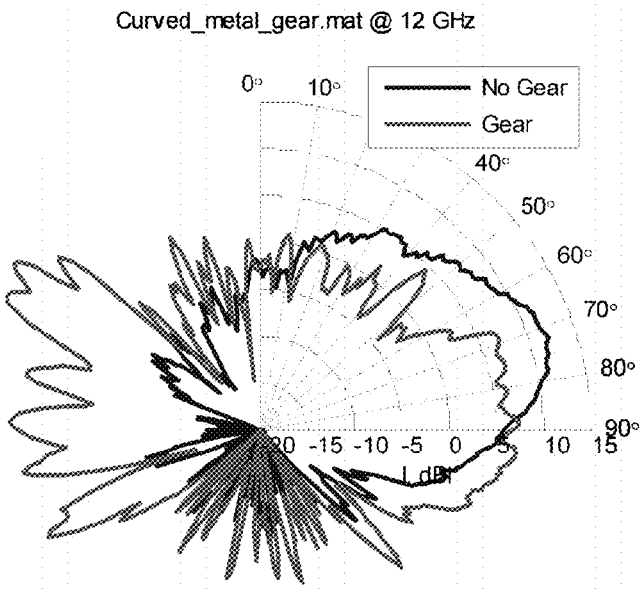

Similar results (see FIGS. 12*a*-12*d* and FIGS. 13*a*-13*d*) were obtained with curved AISAs that are designed to conform to a fuselage profile and to radiate at 90° relative to the normal to the fuselage's bottom. While an antenna feed mounted on a curved metal plate is strongly blocked, distorted and reflected backwards by the obstruction 3 (see FIG. 12*d*) resulting in a reduction of the forward peak by several dB, the curved AIS 10 shows less than 2 dB attenuation due to blockage (FIG. 12*a*), and the radiation patterns of the curved AIS 10 with the wave guiding region 15 (FIGS. 12*a* and 12*b*) show almost no degradation caused by the obstruction 3.

One significant item to note in comparing the patterns from the waveguide feed on the flat metal plates and the curved metal plate (FIGS. 9*d* and 12*d*) is that the curving of the metal plate causes even more of a lift in the radiation pattern because of the finite size of the ground plane. This lift of the radiation pattern when antennas are installed on finite and curved ground plane causes significant degradation in azimuth plane omni coverage. As seen dramatically in FIGS. 12*a*, 12*b* and 12*c*, the AIS 10 completely eliminates the pattern lift.

Figure 13A:
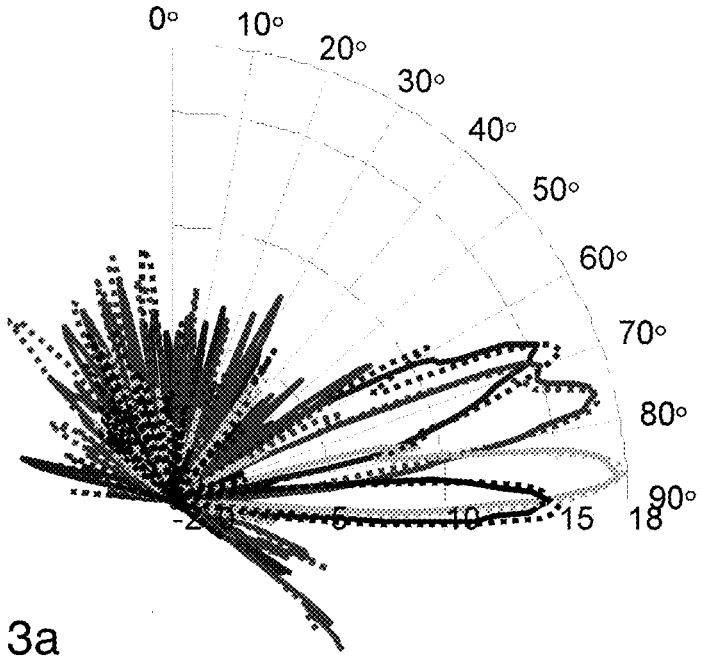
Figure 13B:
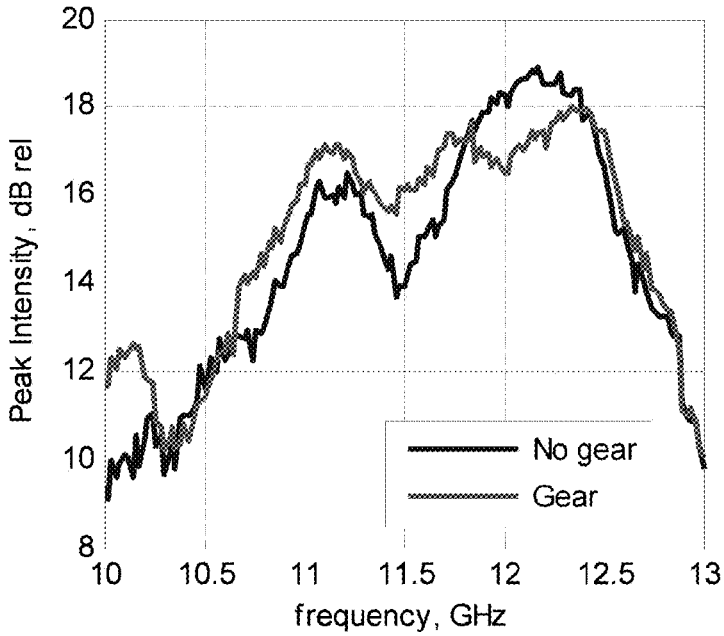
Figure 13C:
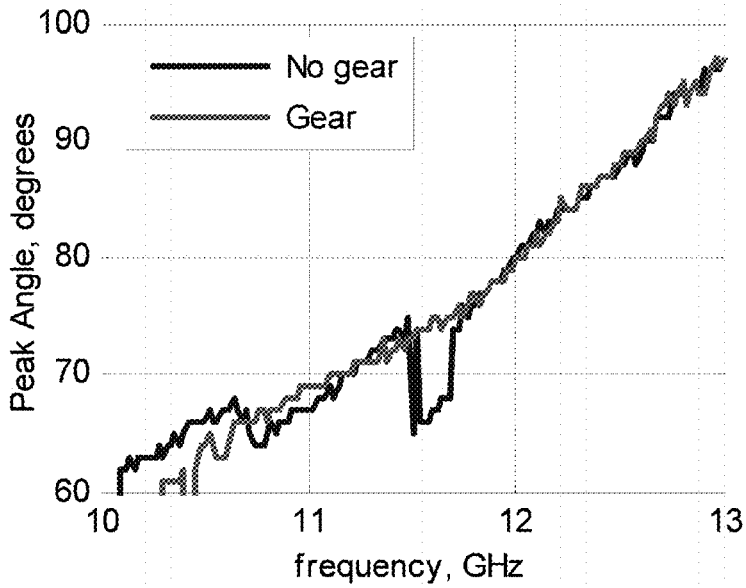
Figure 13D:
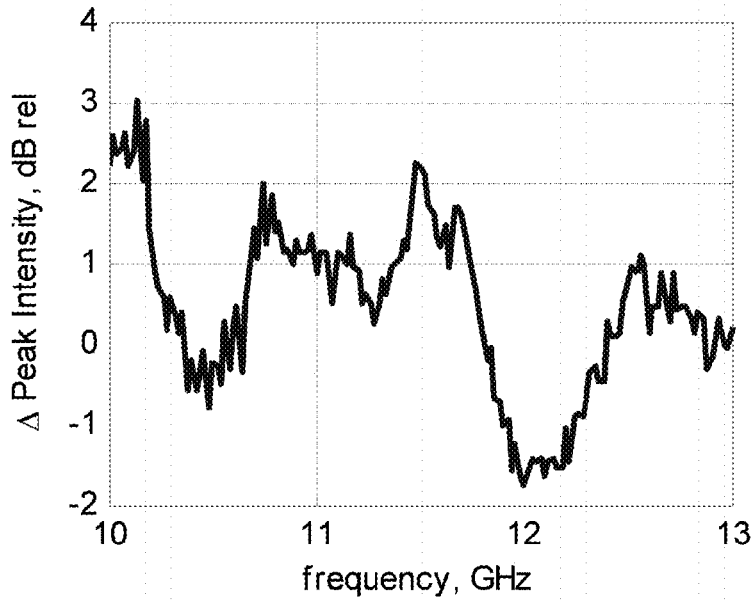

The radiation patterns of the curved AIS 10 with SWG region 15 at several frequencies are plotted in FIG. 13*a*. FIG. 13*c* shows how the peak angle scans with frequency for both the blocked and unblocked cases. There is little difference between the two cases. FIG. 13*b* shows the peak intensity for the blocked and unblocked cases and FIG. 13*d* plots the difference in peak intensity.

Those skilled in the art will appreciate that this disclosure is based on analysis and modeling of techniques which can doubtlessly be applied in actual, full scale applications, such as real life embodiments of the aircraft 1 modeled herein.

This technology can be applied in many other applications. The obstruction 3 for the UAV is a fixed blockage, but this technology can also be applied to movable obstructions or objects which change shape or configuration. The spatial surface-wave impedance function 4 that characterizes the AIS 10 can be permanently designed into the AIS 10 so that it does not change or it can be variable using suitable control signals which control variable capacitors imbedded in or disposed on the AIS 10 for the purpose of controlling its spatial surface-wave impedance function. Those control signals can vary the surface-wave impedance function 4 as a function of how the obstruction 3 changes shape and/position relative to the feed point 2.

This technology can be used to overcome objects, whatever they might be, which block, obstruct, interfere with or hinder the transmission and/or reception of RF signals available at or supplied to a feed point. Most objects of the types mentioned herein will just interfere with the transmission and/or reception of RF signal and not completely block those signals. It is to be understood that the terms 'blockage' and 'obstruction' used herein are intended to embrace the notion that the blockage or obstruction interferes with or hinters the transmission and/or reception of RF signals available at or supplied to a feed point without necessarily completely blocking such transmission and/or reception.

The shape of the antenna does not have to conform to the shape of the aircraft, vehicle or object with which it is associated or mounted upon. The fact that it can be made to conform is believed to be desirable in many applications and/or uses, but an optional feature which need not be utilized.

Having described the invention in connection with certain embodiments thereof, modification will now suggest itself to those skilled in the art. For example, the disclosed embodiment preferably conforms to a frontal portion of an aircraft and is used to circumvent RF blockage caused by a strut. But those skilled in the art will appreciate the fact that the disclosed antenna may conform to the shape of a portion of any aircraft, vehicle or object and moreover the fact that disclosed antenna does not need to conform to the shape of any any aircraft, vehicle or object to which it might be attached or otherwise associated, and still be used successfully to circumvent a RF blockage caused by some interfering or obstructing element. As such, the invention is not to be limited to the disclosed embodiments except as is specifically required by the appended claims.

What is claimed is:

1. A method of mitigating adverse transmission and/or reception effects that an obstruction would otherwise have upon a RF signal to be transmitted or received, the RF signal being available at a feed point and wherein the obstruction is spaced from the feed point in a direction of desired transmission or reception, the method comprising the steps of:

(a) disposing an artificial impedance surface adjacent the feed point and the obstruction, and (b) tuning or causing the artificial impedance surface (i) to have a spatially constant impedance function in a constant impedance region at least immediately adjacent the feed point and (ii) to have a spatially non-constant impedance function in one or more regions spaced from the feed point and closer to the obstruction.

2. The method of claim 1 wherein the artificial impedance surface has said non-constant impedance function in one or more radiation regions where the RF signal is launched from the artificial impedance surface, the one or more radiation regions each occupying a portion of the artificial impedance surface which is spaced from the RF feed point and which is not obstructed by said obstruction at the artificial impedance surface.

3. The method of claim 1 wherein a portion of the artificial impedance surface adjacent the feed point is essentially planar and wherein the one or more radiation regions occur on a curved portion of the artificial impedance surface.

4. The method of claim 3 wherein the curved portion of the artificial impedance surface is curved to following the shape of an object on which the artificial surface is mounted.

5. The method of claim 4 wherein the object is an aircraft.

6. The method of claim 2 further including providing a wave guide region which occupies at least a portion of a line of sight region between the feed point and the obstruction at the surface of the artificial impedance surface, the wave guide region providing a surface-wave guide between the obstruction and feed point that guides surface waves around the obstruction to said one or more radiating regions.

7. The method of claim 6 wherein the wave guide region is smaller in area than the one or more regions of the artificial impedance surface which are tuned to have said non-constant impedance function.

8. The method of claim 7 wherein the wave guide region is substantially surrounded by the one or more regions of the artificial impedance surface which are tuned to have said non-constant impedance function.

9. The method of claim 7 wherein the wave guide region is triangularly shaped when viewed in a plan view thereof.

10. The method of claim 1 wherein the obstruction comprises at least a portion of a structural element which either protrudes or can be extended to protrude from a body of a vehicle.

11. The method of claim 10 wherein the vehicle is an aircraft and the structural element is at least a portion of landing equipment of the aircraft.

12. The method of claim 10 wherein at least one of the spatially constant impedance function and the spatially non-constant impedance function of the artificial impedance surface varies with movement of the obstruction relative to the body of said vehicle.

13. A method of radiating RF energy available from a feed point disposed on object having an obstruction which would normally interfere with radiation of the RF energy at said feed point, said method including emitting RF energy as surface waves on an artificial impedance surface from said feed point, the artificial impedance surface having a first region with a first surface impedance function which supports said surface waves moving away from said feed point and around an area where said obstruction meets said object and having a second region with a second surface impedance function which causes said surface waves to leak or launch off the artificial impedance surface as the radiation of said RF energy away from said artificial impedance surface.

14. The method of claim 13 wherein the first surface impedance function is an essentially constant impedance function and the second impedance function is a spatially non-constant constant impedance function which causes said surface waves to leak or launch off the artificial impedance surface as the radiation.

15. An apparatus for mitigating an effect of a RF obstruction upon a RF signal emitted by a RF feed point, the apparatus comprising:

an artificial impedance surface having the RF feed point disposed on or adjacent the artificial impedance surface and with the RF obstruction being disposed on or adjacent the artificial impedance surface, the artificial impedance surface having an essentially spatially constant impedance function in a region of the artificial impedance surface bounded by the RF feed point and the RF obstruction and with a spatially varying impedance function in regions not bounded by the RF feed point and the obstruction.

16. The apparatus of claim 15 wherein the artificial impedance surface has said spatially varying impedance function in one or more radiation regions where the RF signal is launched from the artificial impedance surface, the one or more radiation regions each occupying a portion of the artificial impedance surface which is spaced from the RF feed point and which is not obstructed by said RF obstruction at the artificial impedance surface.

17. The apparatus of claim 16 further including providing a wave guide region which occupies at least a portion of a line of sight region between the RF feed point and the RF obstruction at the surface of the artificial impedance surface, the wave guide region providing a surface-wave guide between the RF obstruction and RF feed point that guides surface waves around the RF obstruction to said one or more radiation regions.

18. The apparatus of claim 17 wherein the wave guide region is smaller in area than the one or more regions of the artificial impedance surface which are tuned to have said spatially varying impedance function.

19. The apparatus of claim 18 wherein the wave guide region is substantially surrounded by the one or more regions of the artificial impedance surface which are tuned to have said spatially varying impedance function.

20. The apparatus of claim 18 wherein the wave guide region is triangularly shaped when viewed in a plan view thereof.

21. The apparatus of claim 15 wherein the artificial impedance surface has a planar region and a curved region, the RF feed point disposed on or adjacent the planar region and wherein the spatially varying impedance function occurs in said curved region.

22. An artificial impedance surface antenna comprising an artificial impedance surface disposed adjacent an obstruction which protrudes away from said artificial impedance surface and acts as a RF block, the artificial impedance surface having an impedance modulation that routes surface waves released upon the artificial impedance surface around said obstruction and into a radiating region unaffected by the obstruction.

23. The artificial impedance surface antenna of claim 22 wherein the artificial impedance surface has a RF feed point and wherein the obstruction which acts as a RF block is disposed on or adjacent the artificial impedance surface, the artificial impedance having an essentially spatially constant impedance function in a region of the artificial impedance surface bounded by the RF feed point and the RF obstruction and with a spatially varying impedance function in said radiating region.

* * * * *